US005459792A

United States Patent [19]

Reichel et al.

[11] Patent Number: 5,459,792

[45] Date of Patent: Oct. 17, 1995

[54] AUDIO INPUT CIRCUIT FOR VOICE RECOGNITION

[75] Inventors: Ken Reichel, Hudson; Kelly Statham, Cleveland Heights, both of Ohio

[73] Assignee: Audio-Technica U.S., Inc., Stow, Ohio

[21] Appl. No.: 168,047

[22] Filed: Dec. 15, 1993

[51] Int. Cl.[6] ..... H04R 3/00

[52] U.S. Cl. ..... 381/111

[58] Field of Search ..... 381/56, 57, 111, 381/122, 112–115

[56] References Cited

U.S. PATENT DOCUMENTS 4,378,467 3/1983 Ferrantelli ..... 381/111

5,208,866 5/1993 Kato et al. ..... 381/57

*Primary Examiner*—Edward L. Coles, Sr.

*Assistant Examiner*—Jerome Grant, II

*Attorney, Agent, or Firm*—Welsh & Katz, Ltd.

[57] ABSTRACT

An audio input circuit for providing a transducer output signal from a sound transducer to the input of a host device including a universal interface for coupling the transducer output signal to the host device. The universal interface includes a first signal input, a second signal input, a first output conductor, and a second output conductor. Additionally, the audio input circuit includes a switch mechanism coupled between the first and second signal input and between the first and second output conductors for selectively isolating the first output conductor from the second output conductor and for selectively coupling the first output conductor to the second output conductor. The audio input circuit conditions the output of an inexpensive microphone such that the output response of the microphone is ideally suited to the input requirements of the voice recognition host device.

17 Claims, 4 Drawing Sheets

AUDIO INPUT CIRCUIT FOR VOICE RECOGNITION

BACKGROUND OF THE INVENTION

This invention relates generally to audio input circuits for use with a sound transducer and more particularly to audio input circuits for interfacing with host devices such as voice recognition host devices. The invention provides a universal interface such that the audio input circuit may be attached to a variety of voice recognition host devices through various switch settings. Additionally, the audio input circuit conditions the output of an inexpensive microphone such that the output response of the microphone is ideally suited to the input requirements of the voice recognition host device.

Voice recognition systems are being used with increased regularity in industry, the home, and the office. Such systems are typically computer based and are either free standing units or are incorporated within a computer system. Currently, there is no standardized format governing the electrical or physical connections between an input sound transducer, such as a microphone, and differing and various voice recognition host devices. Some systems are self-contained and include a microphone while other systems connect to an externally supplied microphone. Users wishing to attach an external microphone to a voice recognition host device may find that each individual system may require a unique interconnection format such as a differential input signal or a common mode input signal.

Additionally, there are various configurations for supplying power to the microphone. Thus, the use of a particular voice recognition host device selected from a wide array of available systems is cumbersome and inconvenient due to the wide variety of input requirements and interconnection formats available.

Typically, the host device receives audio signals directly from the microphone or receives the signals from a microphone circuit. Often, a two or three wire connector and a plug are used to couple the audio signal to the host device. Additionally, the host device may supply an external DC bias voltage component on one or more of the wires. The DC bias voltage may be used to supply power to the microphone or microphone circuit, or may unique to the host device. In one particular configuration, the external DC bias voltage may be referred to as phantom power when it is used to supply electrical power to the audio input circuit in a balanced, differential mode format. However, the voltage level of the DC bias voltage may be inadequate for use by the audio input circuit. Hence, there is a need to be able to utilize or block the external DC bias voltage supplied by the host device.

Voice recognition host devices accept input from a microphone or similar device and typically process the input signal in accordance with specialized algorithms and signal processing hardware. However, these systems are typically very sensitive to the frequency response characteristics of the signal received. If the microphone signal received has a nonlinear frequency response, or falls off sharply in a particular frequency band, voice recognition performance may be degraded. Typically, voice recognition host devices perform optimally when the input signal received is essentially linear or has a uniform energy spectrum throughout the frequency range of approximately 200 Hz to 10,000 Hz. Usually, high quality, expensive microphones provide this optimal output response. However, the increased cost of such microphones reduces the marketability of many voice recognition systems. In addition, such expensive microphones typically cannot connect directly to more than one type of system. On the other hand, inexpensive microphones typically attenuate sharply below 500 Hz, and respond nonlinearly above 500 Hz exhibiting undesirable variations in amplitude. This nonlinear response of inexpensive microphones impairs voice recognition performance.

Thus, it is an object of the present invention to provide an audio input circuit that substantially overcomes the above problems.

It is another object of the present invention to provide an audio input circuit that universally interfaces to a wide variety of voice recognition host devices.

It is a further object of the present invention to provide an audio input circuit including a universal interface, and filtering to enhance the frequency response characteristics of an inexpensive microphone.

It is an additional object of the present invention to provide an audio input circuit that includes a center-tap transformer for providing an inductive element as part of a filtering circuit.

SUMMARY OF THE INVENTION

The audio input circuit includes a microphone, an adjustable gain control circuit, an amplifier/filter circuit, a universal interface circuit, and a power sensing circuit. A microphone output signal serves as the input to the adjustable gain control circuit and the output of the adjustable gain control circuit serves as the input to the amplifier/filter circuit. The universal interface circuit selectively couples signals between the amplifier/filter circuit and the voice recognition host device. The power sensing circuit supplies electrical power to the amplifier/filter circuit and to various components of the audio input circuit generally through a plurality of wires.

The universal interface may be configured to couple the audio input circuit to many commercially available voice recognition host devices by selectively activating various switches. Additionally, the audio input circuit automatically compensates for poor frequency response characteristics of an inexpensive microphone. The audio input circuit modifies the response of such a microphone to be substantially linear in the frequency region most pertinent to voice recognition systems. Furthermore, low frequency noise components, such as ambient room noise and mechanical microphone handling noise, which contribute adversely to voice recognition performance, are substantially attenuated. Thus, voice recognition performance of the host system is significantly improved.

More specifically, the present audio input circuit provides a transducer output signal from a sound transducer to an input of the host device. The audio input circuit includes a universal interface that couples the transducer output signal to the host device. The universal interface includes a first signal input, a second signal input, a first output conductor, and a second output conductor. A plurality of switches coupled between the first and second signal inputs and between the first and second output conductors are selectively activated to selectively isolate the first output conductor from the second output conductor and may be set to selectively couple the first output conductor to the second output conductor.

The audio input circuit also includes a first selectable DC bias voltage blocking circuit for preventing an external DC voltage present on the first output conductor from appearing on the first signal input. Similarly, a second selectable DC bias voltage blocking circuit prevents an external DC voltage present on the second output conductor from appearing on the second signal input. Additionally, a selectable AC coupling circuit couples at least one of the first signal input or the second signal input to an electrical return path.

The adjustable gain control circuit receives the transducer output signal and the amplifier/filter circuit receives the adjustable gain output for providing an amplified transducer output signal. Additionally, a filter operatively coupled to the amplifier/filter circuit removes low frequency signals from the amplified transducer output signal.

The filter includes resistive, capacitive, and inductive elements configured as a tuned circuit and operatively couples to the amplifier wherein the inductive element is formed by a portion of a primary winding of a transformer. The transformer has a secondary winding with a first terminal operatively coupled to the first signal input, a second terminal operatively coupled to the second signal input, and a third terminal operatively coupled to an external power source. The third terminal of the transformer is a center-tap terminal. The amplified output signal, referred to as the secondary transducer output signal, is generated across the secondary winding of the transformer for connection to the universal interface circuit.

The plurality of switches provided by the universal interface circuit allows the present invention to be connected to a variety of host devices. By selectively activating individual switches, the secondary transducer output signal may be routed to either the first output conductor, the second output conductor, or both. Additionally, by activating the appropriate switches, the selectable AC coupling circuit may couple either the first signal input or the second signal input to an electrical return path. Thus, the secondary transducer output signal may be referenced to ground as may be required by the host device.

DETAILED DESCRIPTION OF THE PREFERRED EMBODIMENTS

Figure 1:
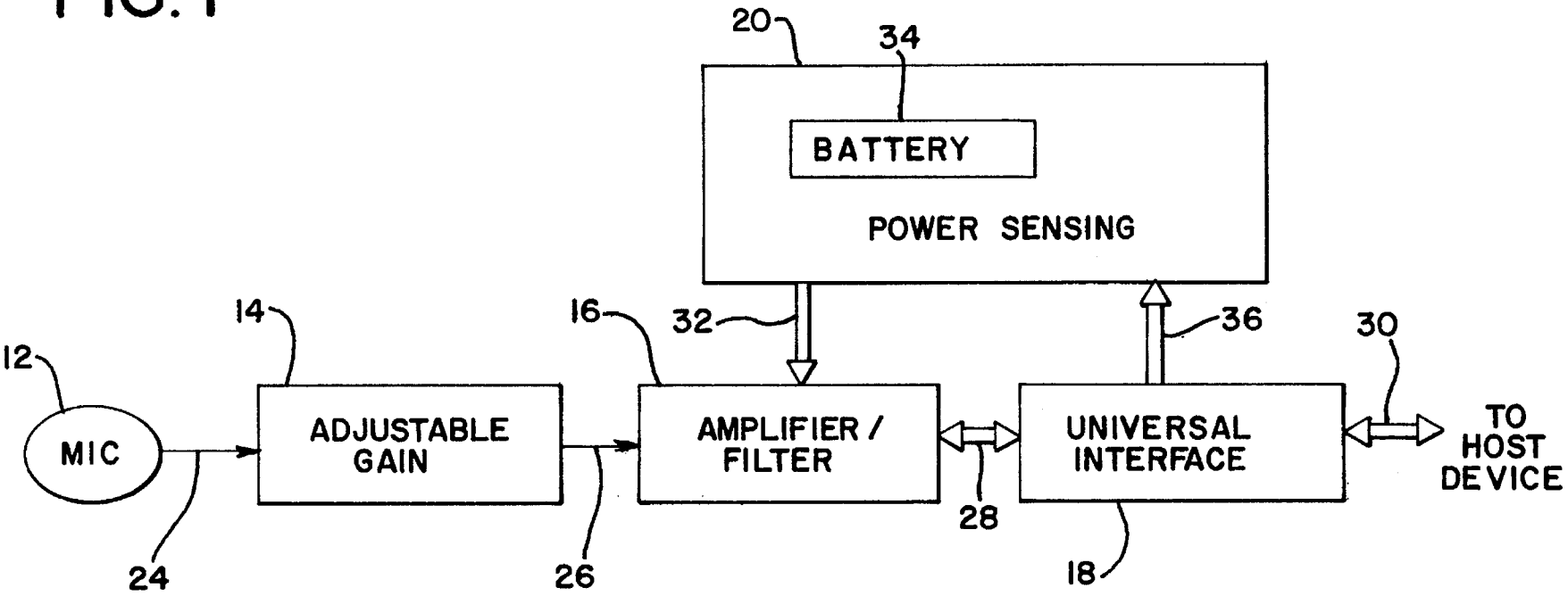
FIG. 1 is a block diagram depicting the major components of the audio input circuit in accordance with the invention.

Referring now to FIG. 1, a block diagram of the audio input circuit 10 is shown. The audio input circuit 10 includes five basic circuit blocks: a microphone 12, an adjustable gain control circuit 14, an amplifier/filter circuit 16, a universal interface circuit 18, and a power sensing circuit 20. A microphone output signal 24 serves as the input to the adjustable gain control circuit 14 and an adjusted output signal 26 serves as the input to the amplifier/filter circuit 16. The universal interface circuit 18 selectively couples signals 28 and signals 30 between the amplifier/filter circuit 16 and the voice recognition host device.

The power sensing circuit 20 supplies electrical power to the amplifier/filter circuit 16 and to various components of the audio input circuit 10 generally through a plurality of wires 32. The power sensing circuit 20 supplies electrical power from either an internal battery source 34 or receives external electrical power from the host device through the universal interface circuit 18. The universal interface circuit 18 may receive power from the voice recognition host device through the plurality of wires 30 and selectively routes the power received, to the power sensing circuit 20 through a plurality of wires 36. Hence, the universal interface circuit 18 selectively facilitates the transfer of output signals from the amplifier/filter circuit 16 to the host device and transfers signals from the host device to the power sensing circuit 20.

Figure 2:
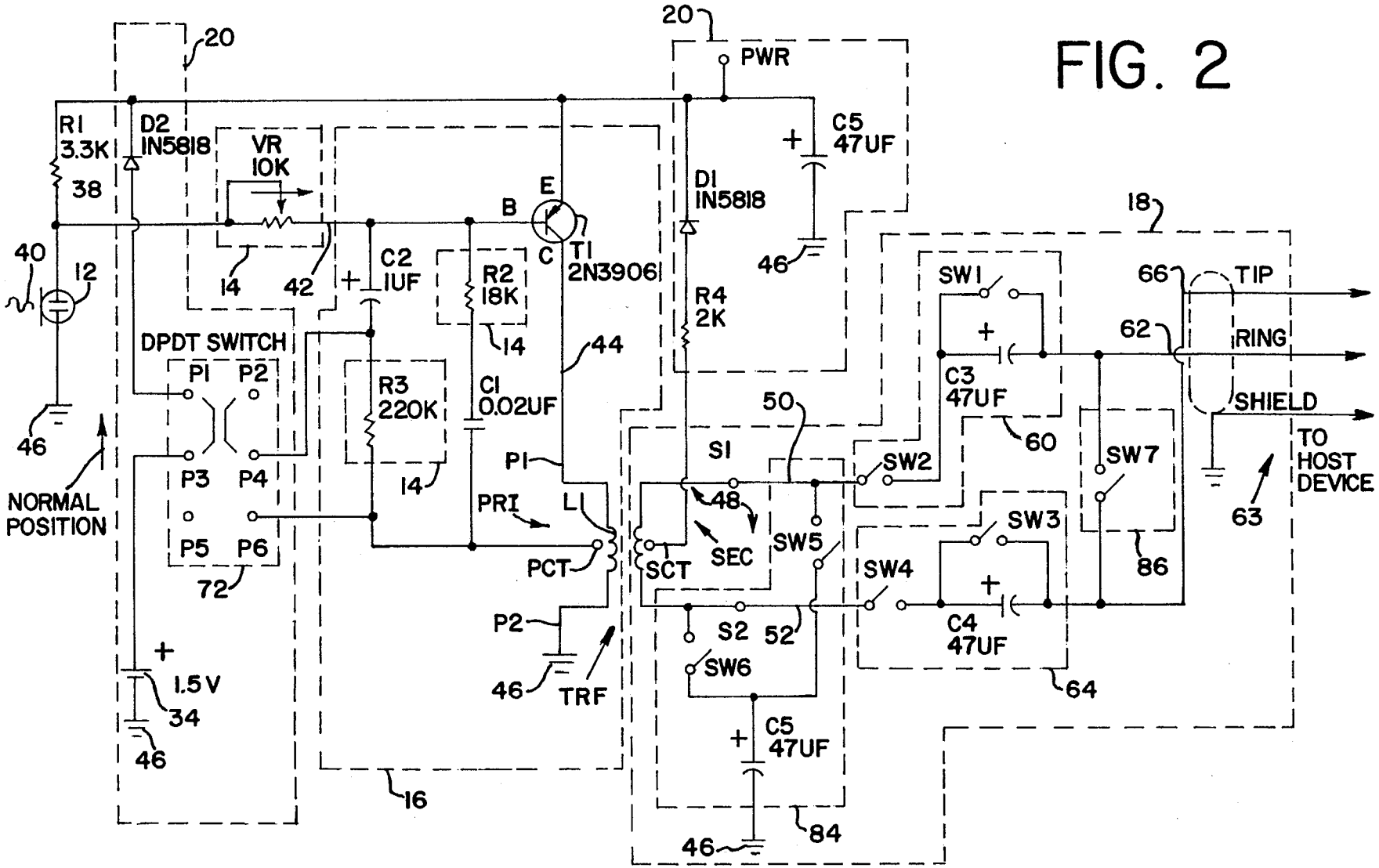
FIG. 2 is a schematic diagram showing one embodiment of the audio input circuit in accordance with the invention.

Referring now to FIG. 2, a schematic diagram of the audio input circuit 10 as connected to a voice recognition host device is generally shown. Such an arrangement for a voice recognition card or voice recognition module may include use in an IBM®, Sun®, Macintosh®, Microsoft®, or other suitable computer system.

Microphone

An electret condenser microphone 12 produces an electrical transducer output signal 38 proportional to the sound pressure levels of an audio input signal 40. The microphone 12 is preferably an electret unidirectional element that includes an FET input converter internal to the microphone as is well known in the art. The FET front-end included in this type of microphone serves as an impedance conversion stage.

A load resistor R1 couples the microphone 12 to an electrical power node PWR, and functions as a load resistor for the FET-type microphone. However, other microphones may be used which do not require the load resistor R1.

Adjustable Gain Control

The transducer output signal 38 serves as an input signal to the adjustable gain control circuit 14. More particularly, the adjustable gain control circuit 14 includes a variable resistive element, such as a potentiometer VR, to provide an adjustable gain. The adjustable gain control circuit 14 includes the potentiometer VR in combination with a resistor R2 where R2 is shown as part of the amplifier/filter circuit 16 as will be described in greater detail below. The potentiometer VR, and the resistor R2, form a voltage divider such that the voltage of the signal received at the base of a transistor T1 is varied by changing the resistance of the potentiometer VR through manual adjustment of the potentiometer. The adjustable gain control circuit 14 allows the amplifier/filter circuit 16 to provide between approximately 6 DB and 20 DB of gain. When the potentiometer VR is set to 0 ohms, maximum gain is achieved, and when set to approximately 10,000 ohms, a minimum gain is achieved.

Transformer

A center-tap transformer TRF provides a primary winding PRI, a secondary winding SEC, a primary center-tap terminal PCT, and a secondary center-tap terminal SCT. The inductance of the primary winding PRI is approximately 7 Henries. A portion of the primary winding PRI provides an inductive element wherein an inductance L1 of approximately 3.5 Henries is provided between the primary center-tap PCT and each terminal P1 and P2 of the primary winding PRI. The inductance L1 acts as the inductive element included in the amplifier/filter circuit 16 as will be described in greater detail below. The center-tap transformer TRF is preferably a Mouser Model TM021, however, other suitable transformers may be used.

Amplifier/Filter

The amplifier/filter circuit 16 includes the transistor T1 arranged in modified common-emitter configuration, as shown, to provide amplification. The transistor T1 is preferably a PNP-type 2N3906 transistor. However, other suitable transistors may be used. The base of the transistor T1 receives an adjusted gain output signal 42 from the output of the adjustable gain control circuit 14. To provide amplification, the emitter-base junction of the transistor T1 is forward-biased and the base-collector junction is reverse-biased as is well known in the art. The emitter of the transistor T1 is directly coupled to the electrical power node PWR while the collector connects to the first terminal P1 of the primary winding PRI. The second terminal P2 of the primary PRI winding connects to ground 46.

The resistor R2 in series with a capacitor C1 couples the base of the transistor T1 with the primary center-tap PCT to produce an RLC circuit combination. Additionally, a resistor R3 in series with a capacitor C2 couples the base of the transistor T1 with the primary center-tap PCT. The primary center-tap PCT couples the collector of the transistor T1 with R3 and C1. Thus, the combination of L1, R2, and C1, provide a tuned resonance filter.

The adjusted gain output signal 42 received by the base of the transistor T1 is amplified by the amplifier/filter circuit 16. An amplified transducer output signal 44 provided by the collector of the transistor T1 is developed across the primary winding PRI of the transformer TRF. Accordingly, a secondary amplified transducer output signal 48 is induced across the secondary winding SEC of the transformer TRF and appears between a first terminal S1 and a second terminal S2 of the secondary winding SEC.

The tuned resonance filter including L1, R2, and C1, in combination with the transistor T1 act as a low frequency filter such that low frequencies, such as those below 150 Hz, are attenuated. These frequencies are typical of ambient room noise and microphone handling noise.

Thus, the amplifier/filter circuit 16 with the center-tap transformer TRF compensates for undesirable transducer output signal 38 characteristics by providing an electrical inversion of the microphone response characteristics. In other words, when the transducer output signal 38 attenuates (drops-out), the amplifier/filter circuit 16 provides additional gain to compensate for the drop-out. When the transducer output signal 38 response is elevated, the amplifier/filter circuit 16 provides attenuation. Thus, for frequencies between approximately 120 Hz and 10,000 Hz, the secondary transducer output signal 48 present at terminals S1 and S2 is substantially linear. For frequencies above 1000 Hz the natural response of the microphone 12 is substantially linear.

Frequency Response

Figure 3:
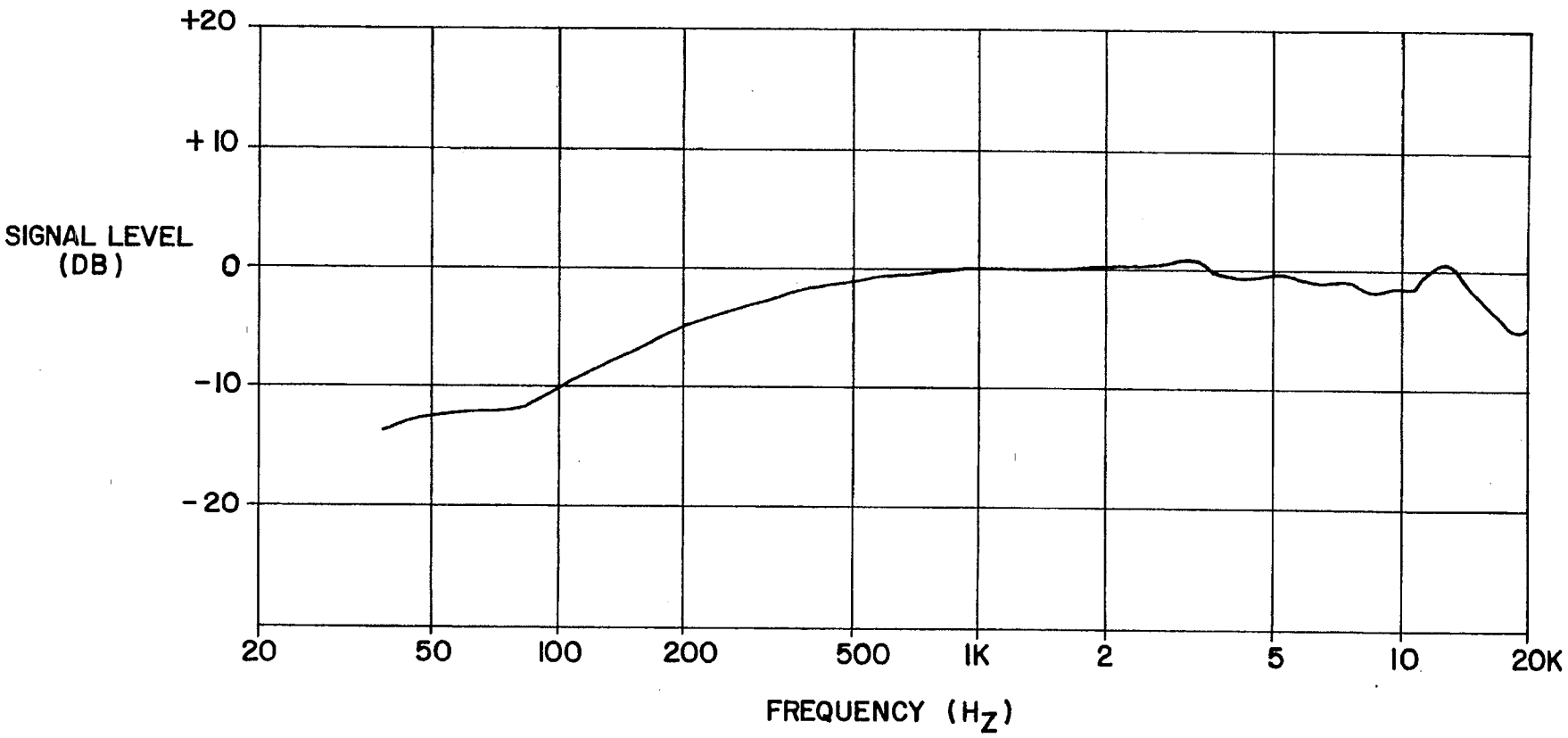
FIG. 3 is a graph depicting the frequency response of a typical inexpensive microphone without use of the present audio input circuit.

Referring now to FIG. 3, a graph shows that the transducer output signal 38 (FIG. 2) is highly nonlinear from approximately 40 Hz through 1,000 Hz. Many voice recognition host devices achieve optimal performance when ambient room noise and microphone handling noise, typically present between approximately 50 Hz and 150 Hz, are sharply attenuated. Optimal performance of the voice recognition host device depends upon the linearity of the transducer output signal 38 between 150 Hz and 10,000 Hz. Thus, most voice recognition host devices perform poorly when a microphone with output characteristics such as those depicted in FIG. 3 is used.

Figure 4:
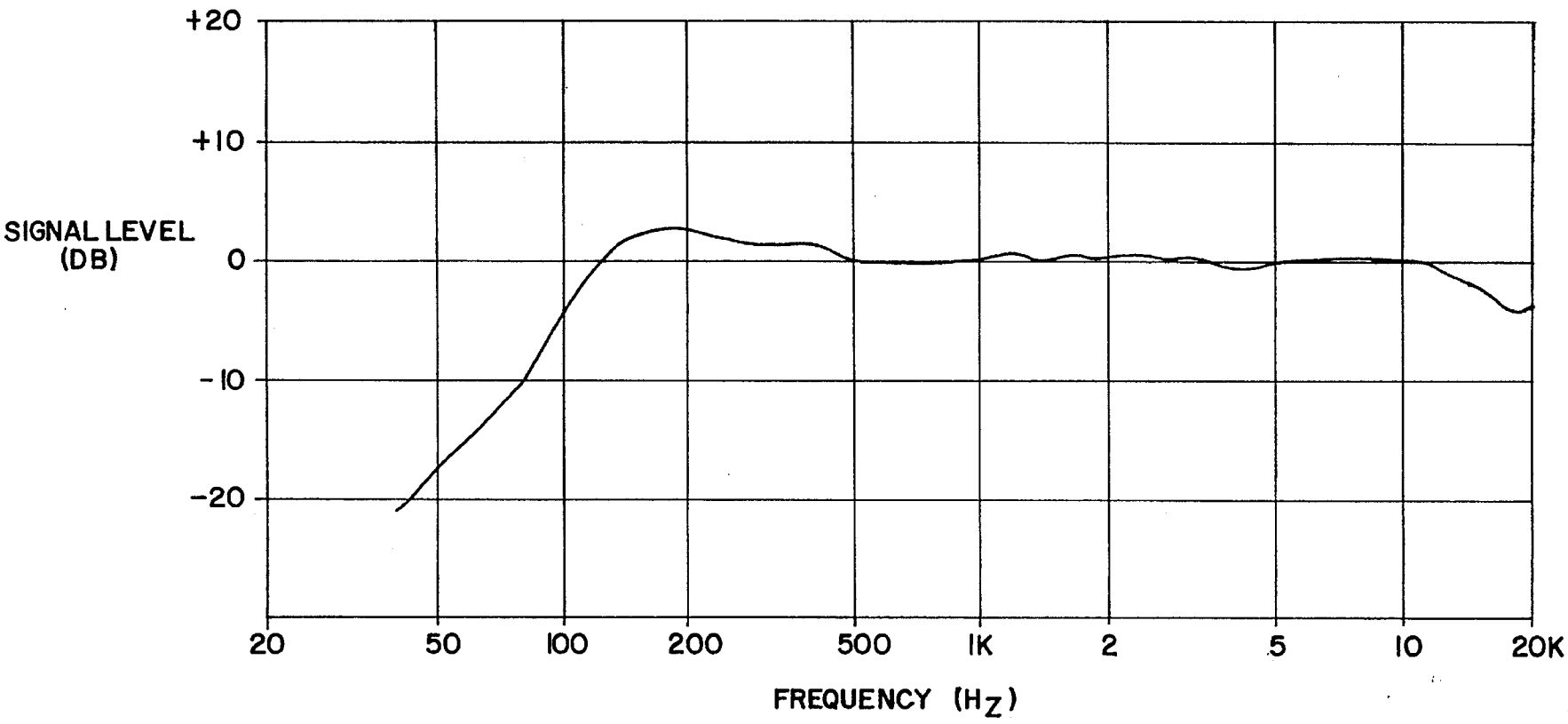
FIG. 4 is a graph depicting the enhanced frequency response of an inexpensive microphone when coupled with the current audio input circuit in accordance with the invention.

Referring now to FIG. 4, a transducer output signal 38 is shown when conditioned and optimized by the present invention as provided at terminals S1 and S2 (FIG. 2). As shown, the signal is attenuated by approximately 10 DB per octave below approximately 150 Hz. This attenuation effectively reduces ambient room noise and microphone handling noise. Additionally, the signal is essentially flat or linear from approximately 150 Hz through 10,000 Hz. Beyond 10,000 Hz, the natural response limitations of the microphone 12 (FIG. 2) cause the signal to attenuate. Thus, the signal characteristics of a microphone as shown in FIG. 4 are ideally suited for connection to the input of voice recognition host devices.

Universal Interface & Power Sensing

Referring back to FIG. 2, the universal interface circuit 18 includes a first signal input 50 connected to the first terminal S1 of the secondary winding SEC. Similarly, a second signal input 52 connects to the second terminal S2 of the secondary winding SEC. Therefore, the first signal input 50 is electrically identical to terminal S1 while the second signal input 52 is electrically identical to terminal S2.

When the first signal input 50 and the second signal input 52 are used as signal inputs to the universal interface circuit 18, they receive the secondary transducer output signal 48 present across the secondary winding SEC. However, the first signal input 50 and the second signal input 52 may also function as outputs for the universal interface 18 when an external DC voltage is supplied by the voice recognition host device as will be described later. In this situation, terminals S1 and S2 may receive the external DC voltage supplied to the universal input circuit 18 from the host device, through the first signal input 50 and the second signal input 52.

A first selectable DC bias voltage blocking circuit 60 couples the first signal input 50 to an interface terminal, such as a ring conductor 62 of a mini-plug 63. Similarly, a second selectable DC bias voltage blocking circuit 64 couples the second signal input 52 to an interface terminal, such as a tip conductor 66 of the mini-plug 63. A grounded interface terminal serves as a shield terminal for a shield conductor 68 of the mini-plug 63. The shield conductor 68 provides a common ground connection between the audio input circuit 10 and the voice recognition host device. The mini-plug 63 is a standard molded connector used to connect the present invention to the voice recognition host device.

Conventional voice recognition host devices may provide an external DC bias voltage to the tip conductor 66 or to the ring conductor 62. Thus, terminal S1, terminal S2, the first signal input 50, and the second signal input 52 may also receive the external DC bias voltage. The external DC bias voltage may be a voltage used to supply power to the audio input circuit 10 and is known as phantom power in one particular configuration as will be described later. However, the external DC bias voltage may not be at appropriate voltage levels useful to the audio input circuit 10 and may require blocking so that the battery 34 can provide the required power. The first and second selectable DC bias voltage blocking circuits 60 and 64 serve to block the external DC bias voltage as will be discussed below in greater detail.

The secondary winding SEC of the transformer TRF provides two functions. First, either terminal S1 or S2 of the secondary winding SEC may receive the external DC bias voltage through either the tip conductor 66 or the ring conductor 62 depending upon the host device. Second, the secondary transducer output signal 48 present across the secondary winding SEC at terminals S1 and S2 is transmitted to the first and second signal inputs 50 and 52 of the universal interface circuit.

As shown, the power sensing circuit 20 includes a phantom diode D1, a battery diode D2, a current limiting resistor R4, a double-pole/double (DPDT) switch 72, and the battery 34. The secondary center-tap SCT of the transformer TRF is configured such that the external DC bias voltage applied to either terminal S1 or S2 is received by the secondary center-tap SCT and is coupled to the cathode of the phantom diode D1 through the current-limiting resistor R4. Diodes D1 and D2 are preferably a 1N5818, however, any suitable diode may be used. When the phantom diode D1 is forward-biased by the external DC bias voltage, the external DC bias voltage appearing at the electrical power node PWR supplies electrical power to the audio input circuit 10. A noise filtering capacitor C5 couples the anode of the phantom diode D1 to ground 46 and reduces noise transients and ripple appearing on the electrical power node PWR.

The battery 34 connects to the power node PWR through a pole P1 of the DPDT switch 72 and the diode D2. The DPDT switch 72 essentially couples the battery 34 to pole P1 since the DPDT switch 72 is configured such that pole P1 and a pole P3 are connected when the DPDT switch 72 is in a normal position. A pole P2 and a pole P4 of the DPDT switch 72 are also connected when the DPDT switch 72 is in the normal position. Additionally, in the normal position, a pole P5 and a pole P6 are isolated from other poles in the DPDT switch 72.

When the voltage level present at the cathode of the phantom diode D1 (due to the external DC bias voltage) is greater than approximately 1.5 volts minus the voltage drop across D2, the battery diode D2 is reverse-biased and acts as an open circuit. Thus, with the DPDT switch 72 in the normal position and the battery diode D2 reverse-biased, the battery 34 is essentially out of the circuit with respect to the power node PWR, and no current will flow from the battery. Therefore, the external DC bias voltage supplied from the secondary center-tap SCT, when greater than the voltage supplied by the battery 34, forces the battery diode D2 to disconnect the battery 34 so that the external DC bias voltage may supply all electrical power.

Similarly, when the external DC bias voltage is either not present or is less than the voltage supplied by the battery, the battery diode D2 is forward-biased and the phantom diode D1 is reverse-biased. This allows the battery 34 to supply all of the electrical power to components of the audio input circuit 10 while preventing the battery current from leaking through the phantom diode D1. Thus, D1, D2, R4, and C5 provide the power sensing circuit 20 for switchably providing electrical power from either an internal battery 34 or from the externally supplied the external DC bias voltage.

The DPDT switch 72 in the normal position allows the power sensing circuit 20 to connect either the battery 34 or the external DC bias voltage to the power supply node PWR. However, when the DPDT switch 72 is in a mute position (opposite from the normal position), pole P3 and pole P5 are coupled while pole P4 and pole P6 are coupled. The resistor R3 in series with the capacitor C2 couples the base of the transistor T1 with the primary center-tap PCT. Poles P4 and P6 couple to opposite ends of resistor R3, thus, when the poles are connected, the resistor R3 is short-circuited and the battery 34 is isolated. When the resistor R3 is short-circuited, AC signals are essentially shunted through the capacitor C2 such that there exists an AC path from the base of the transistor T1 to the primary center tap PCT. Therefore, the transistor T1 operates with near 100% negative feedback and gain is reduced to substantially zero, regardless of the level of the adjusted gain output signal 42. Thus, no amplified transducer output signal 44 is generated across the primary winding PRI and no secondary transducer output signal 48 exists on terminals S1 and S2. This essentially disables the audio input circuit 10 and provides a microphone mute function while simultaneously saving battery power.

The first selectable DC bias voltage blocking circuit 60 includes a DC blocking capacitor C3 in parallel with a parallel DC bias switch SW1, the combination of which is in series with an in-line switch SW2. The second selectable DC bias voltage blocking circuit 64 is similarly formed by a DC blocking capacitor C4 in parallel with a parallel DC bias switch SW3, the combination of which is also in series with an in-line switch SW4. The selectable DC bias voltage blocking circuit 60 prevents an external DC bias voltage present on the ring conductor 62 from appearing on the first signal input 50. Similarly, the second selectable DC bias voltage blocking circuit 64 prevents the external DC bias voltage present on the tip conductor 66 from appearing on the second signal input 52.

The first selectable DC bias voltage blocking circuit 60 couples the first signal input 50 to the ring conductor 62, while the second selectable DC blocking voltage circuit 64 similarly couples the second signal input 52 to the tip conductor 66.

The secondary transducer output signal 48 present at terminals S1 and S2 floats with respect to ground reference. Thus, the secondary transducer output signal 48 present at terminal S1 will be equal in amplitude but opposite in phase and polarity to the secondary transducer output signal present at 48 terminal S2. Since the terminal S1 is identical to the first signal input 50 and the terminal S2 is identical to the second signal input 52, the signal inputs 50 and 52 of the universal interface circuit 18 also float with respect to ground. The floating secondary transducer output signal 48 present at the first and second signal inputs 50 and 52 may be inappropriate for connection to the voice recognition host device in some situations, depending upon the requirements of the host device.

Therefore, a selectable AC coupling circuit 84 provides a mechanism from which to form an electrical return path to ground to essentially ground the signal inputs 50 or 52 of the universal interface circuit 18 when required by the voice recognition host device. A switch SW5 couples the first signal input 50 to an AC coupling capacitor C5. Additionally, a switch SW6 couples the second signal input 52 to the AC coupling capacitor C5. The selectable AC coupling circuit 84 provides two functions. First, by closing either of the switches SW5 or SW6, the corresponding signal input 50 or 52 is coupled to the AC coupling capacitor C5. This essentially creates an AC ground path between the respective signal inputs 50 and 52 and ground 46. Thus, the opposite corresponding signal input 50 or 52 is then referenced to ground 46 as required by the voice recognition host device since the AC coupling capacitor essentially appears as a short-circuit to ground for AC signals.

Second, if the signal inputs 50 or 52 were directly coupled to ground and the voice recognition host device provided the external DC bias voltage on either the tip conductor 66 or the ring conductor 62, this bias voltage would essentially couple to ground causing an excessive current flow, possibly damaging the voice recognition device. Thus, the selectable AC coupling circuit 84 allows the voice recognition host device to provide the external DC bias voltage on either the tip conductor 66 or the ring conductor 62 without short-circuiting such a bias voltage to ground. Additionally, the selectable AC coupling circuit 84 provides a mechanism for selectively coupling least one of the first signal input 50 or the second signal input 52 of the universal interface circuit 18 to an AC ground path.

Thus, when the selectable AC coupling circuit 84 is operative (SW5 or SW6 is closed), the signals appearing at signal inputs 50 and 52 are common mode signals and vary from ground or zero volts to a maximum amplitude. When the selectable AC coupling circuit 84 is not operative, the signal inputs 50 and 52 provide a differential signal as may be required by the voice recognition host device.

An isolation circuit 86 is provided between the first and second signal inputs 50 and 52 and between the tip and ring output conductors 66 and 62 for selectively isolating the first output conductor from the second output conductor and for selectively coupling the first output conductor to the second output conductor. The isolation circuit 86 includes a switch SW7 coupled between the tip conductor 66 and the ring conductor 62 for selectively isolating the tip conductor 66 from the ring conductor 62 so that signals present on the tip conductor 66 are isolated from the ring conductor 62. The switch may also selectively couple the tip conductor 66 and the ring conductor 62 so that the secondary transducer output signal 48 is present on both the tip conductor 66 and the ring conductor 62 as required by the host device.

The plurality of seven switches SW1–SW7 provides a selectable universal interface mechanism for configuring the audio input circuit 10 for connection to most voice recognition host devices. The following Table 1 shows the various combinations of switch positions and the functions provided:

TABLE 1

DIP SWITCH MAP

| Configuration Number | Ring Conductor | Tip Conductor | Shield Conductor | Switches SW1–SW7 1 | 2 | 3 | 4 | 5 | 6 | 7 |
|---|---|---|---|---|---|---|---|---|---|---|
| 1 | DC | Audio | GND | 1 | 1 | 0 | 1 | 1 | 0 | 0 |
| 2 | Audio | DC | GND | 0 | 1 | 1 | 1 | 0 | 1 | 0 |
| 3 | Audio | N/C | GND | 0 | 1 | X | 0 | 0 | 1 | 0 |
| 4 | N/C | Audio | GND | X | 0 | 0 | 1 | 1 | 0 | 0 |
| 5 | Audio/DC | N/C | GND | 1 | 1 | X | 0 | 0 | 1 | 0 |
| 6 | N/C | Audio/DC | GND | X | 0 | 1 | 1 | 1 | 0 | 0 |
| 7 | Audio | Audio | GND | 0 | 1 | X | 0 | 0 | 1 | 1 |
| 8 | Audio/DC | Audio/DC | GND | 1 | 1 | X | 0 | 0 | 1 | 1 |
| 9 | +Audio/DC | −Audio/DC | GND | 1 | 1 | 1 | 1 | 0 | 0 | 0 |

Note:
0 = Open 1 = closed X = don't care
DC = DC bias voltage from host device
N/C = No connection
Audio = Audio output from amplifier/filter circuit Referring to Table 1, "Audio" refers to the secondary transducer output signal 48 present on terminals S1 and S2 while "Audio/DC" indicates that the audio signal is superimposed on a DC bias voltage. Both the audio signal and the DC bias voltage may be combined as required by the host device.

The first configuration shows the external DC bias voltage present on the ring conductor 62. The external DC bias voltage is also present on terminal S1. Switch SW1 and SW2 are both closed so that terminal S1 of the secondary winding SEC receives the external DC bias voltage from the ring conductor 62. Since switch SW3 is open, the DC blocking capacitor C4 blocks any DC bias voltage transmitted from terminal S1 across the secondary winding SEC to terminal S2 from appearing on the tip conductor 66. However, this configuration still allows any AC signal to pass from the second signal input 52 to the tip conductor 66 since SW4 is closed. The tip conductor 66 transmits the secondary transducer output signal 48 from the second signal input 52 to the voice recognition host device. Switch SW5 is closed so that the first signal input 50 is AC-coupled to ground 46. Thus, the AC audio output signal present on the tip conductor is referenced to ground as required by the voice recognition host device. Switch SW7 is open so that the tip conductor 66 and the ring conductor 62 are isolated from each other.

Configuration number 2 is similar to configuration 1, however, the functions of the tip conductor 66 and the ring conductor 62 are reversed. Hence, the tip conductor 66 receives the external DC bias voltage while the ring conductor 62 supplies the AC audio output signal to the voice recognition host device. Accordingly, the switch positions SW1–SW7 are modified as shown in Table 1.

In configuration number 3, the secondary transducer output signal 48 is present on the ring conductor 62 while the tip conductor 66 is isolated. Switch SW4 and SW3 are opened since the tip conductor 66 is isolated. The ring conductor 62 transmits the secondary transducer output signal 48 from the first signal input 50 to the voice recognition host device. Thus, switch SW2 must be closed. Since, switch SW1 is open, the DC blocking capacitor C3 blocks any external DC bias voltage present on terminal S1 from appearing on the ring conductor 66 while allowing and the audio output signal to pass. Switch SW6 is closed so that second signal input 52 is AC-coupled to ground 46. Thus, the output signal present on the ring conductor 62 is referenced to ground 46 as required by voice recognition host device.

Configuration number 4 is similar to configuration 3, however, the functions of the tip conductor 66 and the ring conductor 62 are reversed. Hence, the tip conductor 66 supplies the secondary transducer output signal 48 to the voice recognition host device while the ring connector 62 is isolated. Accordingly, the switch positions SW1–SW7 are modified as shown in Table 1.

In configuration number 5, the external DC bias voltage and the secondary transducer output signal 48 are present on the ring conductor 62. Switch SW1 and SW2 are both closed so that the terminal S1 receives the external DC bias voltage from the ring conductor 62 and so that the secondary transducer output signal 48 present at the signal input 50 appears on the ring conductor 62. Switch SW6 is closed so that the second signal input 52 is AC-coupled to ground 46. Thus, the secondary transducer output signal 48 present on the ring conductor 62 is referenced to ground 46 as required by the voice recognition host device. Switch SW4 is open since the tip conductor 66 is isolated. Switch SW7 is also opened so that the tip conductor 66 and the ring conductor 62 are isolated from each other.

Configuration number 6 is similar to configuration 5, however, the functions of the tip conductor 66 and the ring conductor 62 are reversed. Hence, the tip conductor 66 receives the external DC bias voltage and transmits the secondary transducer output signal 48 to the voice recognition host device while the ring conductor 62 is isolated. Accordingly, the switch positions SW1–SW7 are modified according to Table 1.

In configuration number 7, the secondary transducer output signal 48 is present on both the tip conductor 66 and the ring conductor 62 while no external DC bias voltage is present. Switch SW1 is open and SW2 is closed so that ring conductor 62 transmits the secondary transducer output signal 48 to the voice recognition host device. The switch SW4 is open while the switch SW7 is closed, thus, the tip conductor 66 and the ring conductor 62 are essentially coupled through switch SW7. Switch SW6 is closed so that the second signal input 52 is AC-coupled to ground 46. Thus, the secondary transducer output signal 48 present on both the tip conductor 66 and the ring conductor 62 is AC-coupled to ground 46 as required by the voice recognition host device.

In configuration number 8, the external DC bias voltage is present on both the ring conductor 66 and the tip conductor 62. Additionally, the secondary transducer output signal 48 is present on both the tip and ring conductors 62 and 66. Switch SW1 and SW2 are closed so that terminal S1 receives the external DC bias voltage. Additionally, the secondary transducer output signal 48 present at the signal input 50 is transmitted to the ring conductor 62. Since SW4 is open and switch SW7 is closed, the tip and ring conductors 66 and 62 are essentially coupled through switch SW7. Switch SW6 is closed so that the second signal input 52 is AC-coupled to ground 46. Thus, the secondary transducer output signal 48 present on the tip and ring conductors 66 and 62 is referenced to ground 46 as required by the voice recognition host device.

In configuration number 9, the external DC bias voltage is present on both the ring conductor 62 and the tip conductor 66. In this particular configuration, the external DC bias voltage is phantom power. Thus, switches SW1–SW4 are closed such that terminals S1 and S2 receive phantom power. However, switches SW5 and SW6 are both open and both signal inputs 50 and 52 are isolated from an AC ground path and float with respect to the ground reference 46. This configuration supplies a differential output wherein the positive component of secondary transducer output signal 48 is present on the ring conductor 62 and the negative component of secondary transducer output signal is present on the tip conductor 66. However, the two signals are inverse in amplitude and opposite in phase as required by the voice recognition host device, thus, providing a differential output.

The present invention may be a stand-alone unit or may be packaged within a microphone housing. The present invention may be small enough to be mounted within the microphone base housing or platform as is common with many microphones.

It will be recognized that the universal interface circuit 18 may be modified to include only one or various combinations of the first selectable DC bias blocking voltage circuit 60, the second selectable DC bias blocking voltage circuit 64, the selectable AC coupling circuit 84, and the isolation circuit 86 to facilitate interfacing the microphone with a plurality of host devices.

For example, the microphone may be coupled to the host device using the first selectable DC bias voltage blocking circuit 60 by appropriately setting switches SW1 and SW2. This would couple the secondary transducer output signal 48 to the ring conductor 62. Alternatively, the microphone may be coupled to the host device using the second selectable DC bias voltage blocking circuit 64 by appropriately setting switches SW3 and SW4. This would couple the secondary transducer output signal 48 to the tip conductor 66.

Additionally, the microphone may be coupled to the host device using the selectable AC coupling circuit 84 by appropriately setting switches SW5 and SW6. This would couple the secondary transducer output signal to an electrical return. This configuration would provide a ground reference for the secondary transducer output signal 48 present on either the tip output conductor 66 or the ring output conductor 62.

Additionally, it is contemplated that the above described invention may include only the microphone and the universal interface circuit 18. If the microphone had output characteristics suitable for direct connection to the voice recognition host device, the adjustable gain control circuit and the amplifier/filter circuit could be bypassed. This would allow a user with a suitable quality microphone to attach the microphone to a variety of host devices by selecting the appropriate combinations of switches within the universal interface.

While the preferred embodiment of the present audio input circuit has been shown and described, it will be appreciated by those skilled in the art that changes and modifications may be made thereto without departing from the spirit and scope of the invention in its broader aspects and as set forth in the following claims.

What is claimed is:

1. An audio input circuit for providing a transducer output signal from a sound transducer to an input of a host device, comprising:

universal interface means for coupling the transducer output signal to the host device, said universal interface means having a first signal input, a second signal input, a first output conductor, and a second output conductor; and switch means coupled between said first and second signal inputs and between said first and second output conductors for selectively isolating said first output conductor from said second output conductor and for selectively coupling said first output conductor to said second output conductor, said switch means comprising:

first selectable DC bias voltage blocking means for preventing a DC voltage present on said first output conductor from appearing on said first signal input.

2. The audio input circuit as defined in claim 1 wherein said switch means further comprises:

selectable AC coupling means for coupling at least one of said first signal input or said second signal input to a ground path.

3. The audio input circuit as defined in claim 2 wherein said selectable AC coupling means further comprises:

an AC coupling capacitive element; and

AC coupling switch means for coupling said capacitive element to a ground path.

4. The audio input circuit as defined in claim 1 wherein said first selectable DC bias voltage blocking means further comprises:

a first DC bias switch means in series with a parallel combination of a second DC bias switch means and a first capacitive element; and said first and second DC bias switch means and capacitive element are coupled between said first signal input and said first output conductor.

5. The audio input circuit as defined in claim 1 wherein said first output conductor and said second output conductor are formed in a plug for connecting to the host device, said plug further comprising:

a shield output conductor for common connection between said plug an the host device.

6. The audio input circuit as defined in claim 1 further comprising:

an adjustable gain circuit for receiving the transducer output signal and having an adjustable gain output;

an amplifier circuit operatively coupled to receive said adjustable gain output to provide an amplified transducer output signal; and filter means operatively coupled to said amplifier circuit for removing low frequency signals from said amplified transducer output signal.

7. The audio input circuit as defined in claim 6 wherein said filter means further comprises:

resistive, capacitive, and inductive elements configured as a tuned circuit and operatively coupled to said amplifier; and a transformer having at least a portion of a primary winding forming said inductive element.

8. The audio input circuit as defined in claim 6 wherein said adjustable gain circuit further comprises:

a variable resistive element for providing an adjustable gain.

9. The audio input circuit as defined in claim 6 wherein said amplifier further comprises:

a transistor having an emitter, a base for receiving said adjustable gain output, and a collector for providing said amplified transducer output signal, said filter means operatively coupled between said base and said collector.

10. The audio input circuit as defined in claim 6 further comprising:

an internal electrical power source for optionally supplying power;

power sensing means for switchably providing electrical power from said internal power source or from an external power source; and a transformer having a secondary winding, said secondary winding having a first terminal operatively coupled to said first signal input, a second terminal operatively coupled to said second signal input, and a third terminal operatively coupled to said external power source.

11. The audio input circuit as defined in claim 10 wherein said power sensing means decouples said internal power source when said external power source is beyond a predetermined threshold and is present on at least one of said first output conductor or said second output conductor, and said power sensing means couples said internal power source when said external power source is not present.

12. An audio input circuit for providing a transducer output signal from a sound transducer to an input of a host device, comprising:

universal interface means for coupling the transducer output signal to the host device, having a first signal input, a second signal input, a first output conductor, and a second output conductor;

first selectable DC bias voltage blocking means for preventing a DC voltage present on said first output conductor from appearing on aid first signal input;

an adjustable gain circuit for receiving the transducer output signal and having an adjustable gain output;

an amplifier circuit operatively coupled to receive said adjustable gain output to provide an amplified transducer output signal; and filter means operatively coupled to said amplifier circuit for removing low frequency signals from said amplified transducer output signal, said filter means comprising:

resistive, capacitive, and inductive elements configured as a tuned circuit and operatively coupled to said amplifier; and a transformer having at least a portion of a primary winding forming said inductive element.

13. The audio input circuit as defined in claim 12 further comprising:

selectable AC coupling means for coupling at least one of said first signal input or said second signal input to a ground path.

14. The audio input circuit as defined in claim 13 wherein said universal interface means further comprises:

second selectable DC bias voltage blocking means for preventing a DC voltage present on said second output conductor from appearing on said second signal input.

15. An audio input circuit for providing a transducer output signal from a sound transducer to an input of a host device, comprising:

(a) universal interface means for coupling the transducer output signal to the host device, having a first signal input, a second signal input, a first output conductor, and a second output conductor, said universal interface means having first selectable DC bias voltage blocking means for preventing a DC voltage present on said first output conductor from appearing on said first signal input, said first selectable DC bias voltage blocking means further including a first DC bias switch means in series with a parallel combination of a second DC bias switch means and a first capacitive element;

second selectable DC bias voltage blocking means for preventing a DC voltage present on said second output conductor from appearing on said second signal input, said second selectable DC bias voltage blocking means further including a third DC bias switch means in series with a parallel combination of a fourth DC bias switch means and a second capacitive element;

selectable AC coupling means for coupling at least one of said first signal input or said second signal input to an electrical return path;

(b) an adjustable gain circuit for receiving the transducer output signal and having an adjustable gain output;

(c) an amplifier circuit operatively coupled to receive said adjustable gain output to provide an amplified transducer output signal;

(d) filter means operatively coupled to said amplifier circuit for removing low frequency signals from said amplified transducer output signal; and (e) wherein said first output conductor and said second output conductor are formed in a plug for connecting to the host device, said plug further including a shield output conductor for common connection between said plug an the host device.

16. The audio input circuit as defined in claim 15 further comprising:

a transformer having a secondary winding, said secondary winding having a first terminal operatively coupled to said first signal input, a second terminal operatively coupled to said second signal input, and a third terminal operatively coupled to said external power source; and wherein first, second, third, and fourth DC bias switch means are dual-in-line package (DIP) switches.

17. An audio input circuit for providing a transducer output signal from a sound transducer to an input of a host device, comprising:

universal interface means for coupling the transducer output signal to the host device, said universal interface means having a first signal input, a second signal input, a first output conductor, and a second output conductor;

switch means coupled between said first and second signal inputs and between said first and second output conductors for selectively isolating said first output conductor from said second output conductor and for selectively coupling said first output conductor to said second output conductor, and an inductive element that couples said first signal input to said second signal input.

* * * * *